US006396377B1

(12) United States Patent
Ying

(10) Patent No.: US 6,396,377 B1
(45) **Date of Patent: *May 28, 2002**

(54) LIQUID CRYOGEN-FREE SUPERCONDUCTING MAGNET SYSTEM

(75) Inventor: Leong Ying, Bethlehem, PA (US)

(73) Assignee: Everson Electric Company, Bethlehem, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/645,911

(22) Filed: Aug. 25, 2000

(51) Int. Cl.[7] ..... H01F 7/00
(52) U.S. Cl. ..... 335/300; 335/216; 505/892
(58) Field of Search ..... 335/216, 299, 335/300, 301; 324/318–321; 62/50.1, 50.2, 51.1–51.3; 505/892–898

(56) References Cited

U.S. PATENT DOCUMENTS

| | | | | |
|---|---|---|---|---|
| 4,924,198 A | | 5/1990 | Laskaris | |
| 5,103,647 A | | 4/1992 | Ackermann | |
| 5,301,507 A | | 4/1994 | Laskaris et al. | |
| 5,394,129 A | | 2/1995 | Obasih et al. | |
| 5,412,363 A | | 5/1995 | Breneman et al. | |
| 5,426,949 A | | 6/1995 | Saho et al. | |
| 5,442,928 A | | 8/1995 | Laskaris et al. | |
| 5,448,214 A | | 9/1995 | Laskaris | |
| 5,489,848 A | * | 2/1996 | Furukawa | 324/318 |
| 5,517,169 A | | 5/1996 | Laskaris et al. | |
| 5,563,566 A | | 10/1996 | Laskaris et al. | |
| 5,584,184 A | | 12/1996 | Inaguchi et al. | |
| 5,651,256 A | | 7/1997 | Herd et al. | |
| 5,757,243 A | | 5/1998 | Mizuno et al. | |
| 5,842,348 A | * | 12/1998 | Kaneko et al. | 62/51.1 |
| 5,934,082 A | | 8/1999 | Steinmeyer | |
| 5,939,962 A | * | 8/1999 | Tahara et al. | 335/216 |
| 5,960,868 A | * | 10/1999 | Kuriyama et al. | 62/51.1 |
| 5,966,944 A | | 10/1999 | Inoue et al. | |
| 6,065,295 A | * | 5/2000 | Hafner et al. | 62/6 |
| 6,093,318 A | * | 7/2000 | Saho et al. | 210/208 |
| 6,154,110 A | * | 11/2000 | Takeshima | 335/299 |

* cited by examiner

*Primary Examiner*—Lincoln Donovan
(74) *Attorney, Agent, or Firm*—Ratner & Prestia

(57) ABSTRACT

A superconducting magnet assembly having two individual magnetic coils contained in separate vacuum jackets with a radiation shield between each magnet and its respective vacuum jacket. Each magnet coil is cooled to superconducting temperature by direct coupling to the second stage of a separate two stage closed cycle refrigerator. A first stage of each refrigerator cools an associated radiation shield.

15 Claims, 6 Drawing Sheets

LIQUID CRYOGEN-FREE SUPERCONDUCTING MAGNET SYSTEM

BACKGROUND OF THE INVENTION

The present invention pertains to a superconducting magnet having two separate magnet coils.

Superconductivity is a phenomena whereby certain materials lose all electrical resistance when the temperature of the material is lowered below a certain critical point. Although superconductivity was discovered at the turn of the last century, it was not until the advent of superconducting alloys such as niobium titanium (Nb Ti) in the early days of the decade of the 1960's that the superconductivity effect was put to practical use, particularly in the production of very high-field superconducting magnets. Low temperature superconductors require refrigeration at temperatures close to absolute zero (0° K or −273° C.) before the critical superconducting limits are reached. At these low temperatures, the only refrigerant medium that can be used is helium. The normal boiling point of liquid helium at one atmosphere is 4.2° K.

In the 1980's, high temperature superconductors (HTS) were discovered. Unlike the low temperature superconducting materials which tend to be metallic alloys and compounds, the new high temperature superconducting materials are ceramic based. Because of the brittle nature of these ceramic-like materials, high temperature superconductors are currently confined mainly for use as straight sectioned current leads.

U.S. Pat. No. 5,442,929 discloses and claims a compact conduction-cooled superconducting magnet wherein the magnet is cooled by liquid helium with the evaporating liquid helium re-condensed by a closed cycle refrigerator. All of the main coils are wired in series and powered together.

U.S. Pat. No. 5,448,214 discloses and claims an actively-shielded open MRI high-temperature niobium tin superconducting magnet, conduction cooled by a high-temperature cryo cooler. The niobium-tin superconductor is cooled to 10° K using a closed cycle refrigerator to cool both halves of the magnet coil. The second coil is conduction cooled to the first coil which is then in turn conduction cooled by the closed cycle refrigerator.

U.S. Pat. No. 5.448,214 discloses and claims an actively-shielded open MRI high-temperature niobium tin superconducting magnet, conduction cooled by a high-temperature cryo cooler. The niobium-tin superconductor is cooled to 10° K using a closed cycle refrigerator to cool both halves of the magnet coil. The second coil is conduction cooled to the first coil which is then, in turn, conduction cooled by the closed cycle refrigerator.

U.S. Pat, No. 5,412,363 discloses and claims an open MRI superconducting magnet cooled by a single closed cycle refrigerator. The coils of the magnet according to patentee are energized in series and powered up to produce a homogenous high central field. The liquid helium returns to the closed cycle refrigerator for recondensing. According to patentees, the first magnet coil is cooled by first circulating liquid helium around the heat exchange circuit associated with the first magnet coil. After circulating around the first heat exchange circuit. the helium is returned to the refrigerator for re-cooling before it passes around the heat exchanger associated with the second magnet coil. The MRI superconducting magnet is operated in persistence made where the current is perpetually circuited internally, separate from the power supply.

U.S. Pat. No. 5,934,082 discloses indirect cooling of a magnetic device in order to reduce vibration by using low-vibration thermal coupling. Patentees describe using a 10° K (high-temperature) cryo cooler with no cooling system described in detail.

SUMMARY OF THE INVENTION

The present invention pertains to a superconducting magnet having at least two magnet coils separated from one another. The magnetic coils are so constructed and arranged to provide a central magnetic field that is accessible along an X, Y, and Z axis with the axis generation point being at the center of the magnetic field. The magnet according to the invention has full open access to the central magnetic field.

According to the present invention, each of the magnet coils is contained in a separate vacuum jacket with an intermediate radiation shield disposed between the magnet and the vacuum jacket. A two stage closed cycle cryogenic refrigerator is directly coupled to the magnet coil and the radiation shield. The first stage of the cryogenic refrigerator is in direct thermal contact with the radiation shield and the second or colder stage of the closed cycle refrigerator is in direct thermal contact with the magnet. With a system according to the present invention, the magnet can be cooled to cryogenic temperatures utilizing only the closed cycle refrigerator. Inclusion of a coil of conductive tubular material around each magnet coil through which a liquid cryogen (e.g. liquid nitrogen or liquid helium) can be circulated, can significantly reduce the cool-down time for the magnet coil. By circulating the liquid cryogen through the tubing, more rapid cool-down of the magnet coils can be effected.

Therefore, in one aspect, the present invention is a superconducting magnet assembly comprising, in combination, two separate generally toroidally shaped magnet coils positioned in spaced apart relationship to define access to a magnetic field along X, Y, and Z axes originally from the center of the magnetic field; each of the magnetic coils contain within, and spaced apart from an outer vacuum jacket, at least one radiation shield disposed within each of the vacuum jackets between each of the magnet coils and its vacuum jacket, and a separate two stage closed cycle refrigerator adapted to cool each of the magnets to a temperature of about 4° K and each of the radiation shields to a temperature of about 50° K.

In another aspect, the present invention is a superconducting magnet assembly comprising, in combination, two separate generally toroidally shaped magnet coils positioned in spaced apart relationship to define access to a magnetic field along X, Y, and Z axes originally from the center of the magnetic field; each of the magnetic coils contain within, and spaced apart from an outer vacuum jacket, at least one radiation shield disposed within each of the vacuum jackets between each of the magnet coils and its vacuum jacket, a separate two stage closed cycle refrigerator adapted to cool each of the magnets to a temperature of about 4° K and each of the radiation shields to a temperature of about 50° K, and auxiliary means to cool the magnet coils by circulating a liquid cryogen around the magnet coils.

DETAILED DESCRIPTION OF THE INVENTION

With the advent of improved two stage, closed cycle cryogenic refrigerators, one type many refer to as a Gifford-McMahon refrigerator, they permit cooling of superconducting magnets by direct thermal connection to the refrigerator by mechanical means. This can supplant traditional cooling of superconducting magnets by immersion in a bath of liquid helium.

However, it has been discovered that while the improved two stage cryogenic refrigerators can achieve the same base temperature as liquid helium for cooling superconducting magnets, they still lack sufficient cooling capacity to allow the use of traditional vapor-cooled resistive current leads. Using high temperature superconductors as current leads eliminates the final hurdle to achieving a complete liquid cryogen-free superconducting magnet system.

Figure 1:
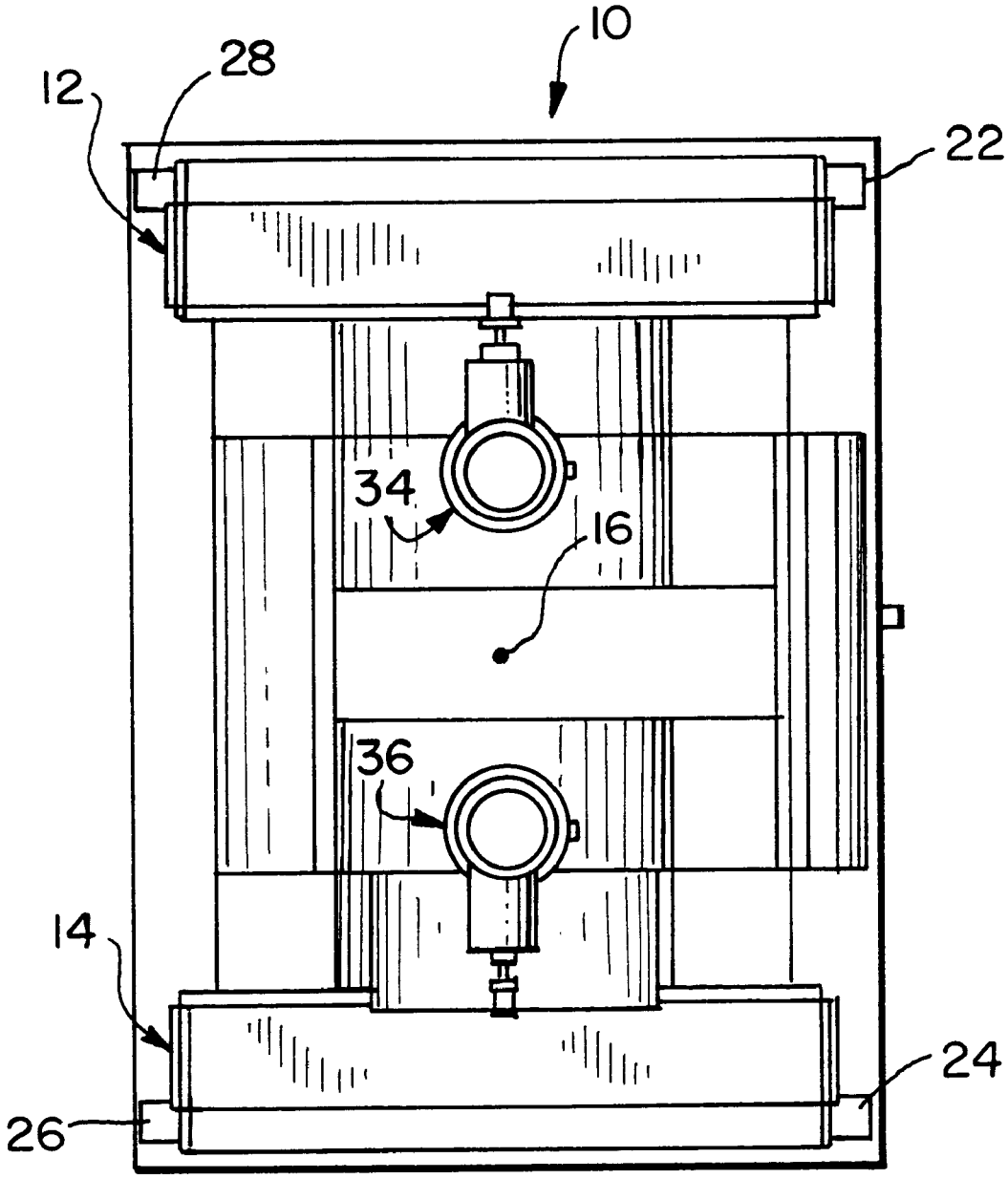
FIG. 1 is a top view of the magnet assembly according to the present invention.
Figure 2:
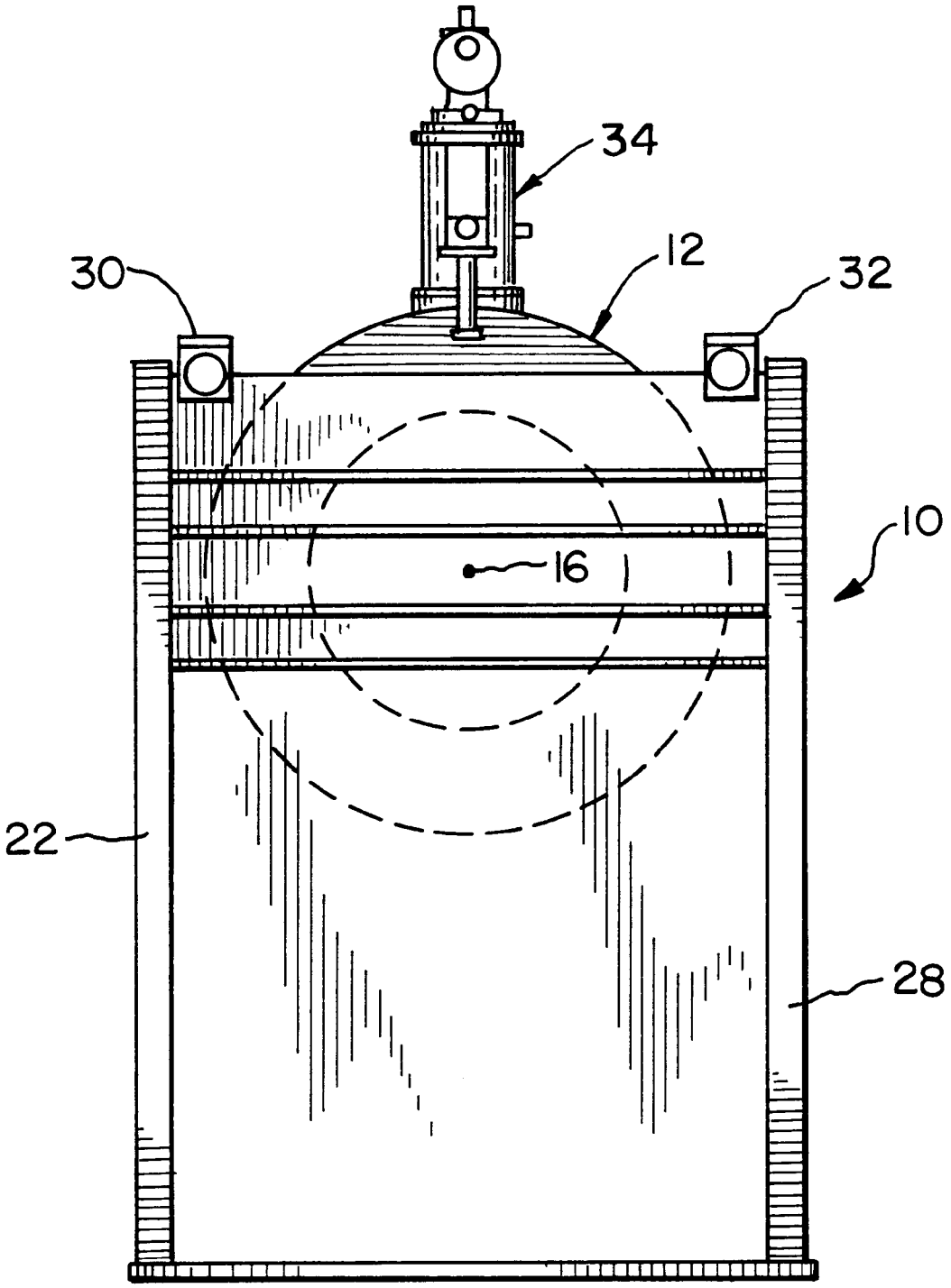
FIG. 2 is a right side view of the magnet assembly of FIG. 1.
Figure 3:
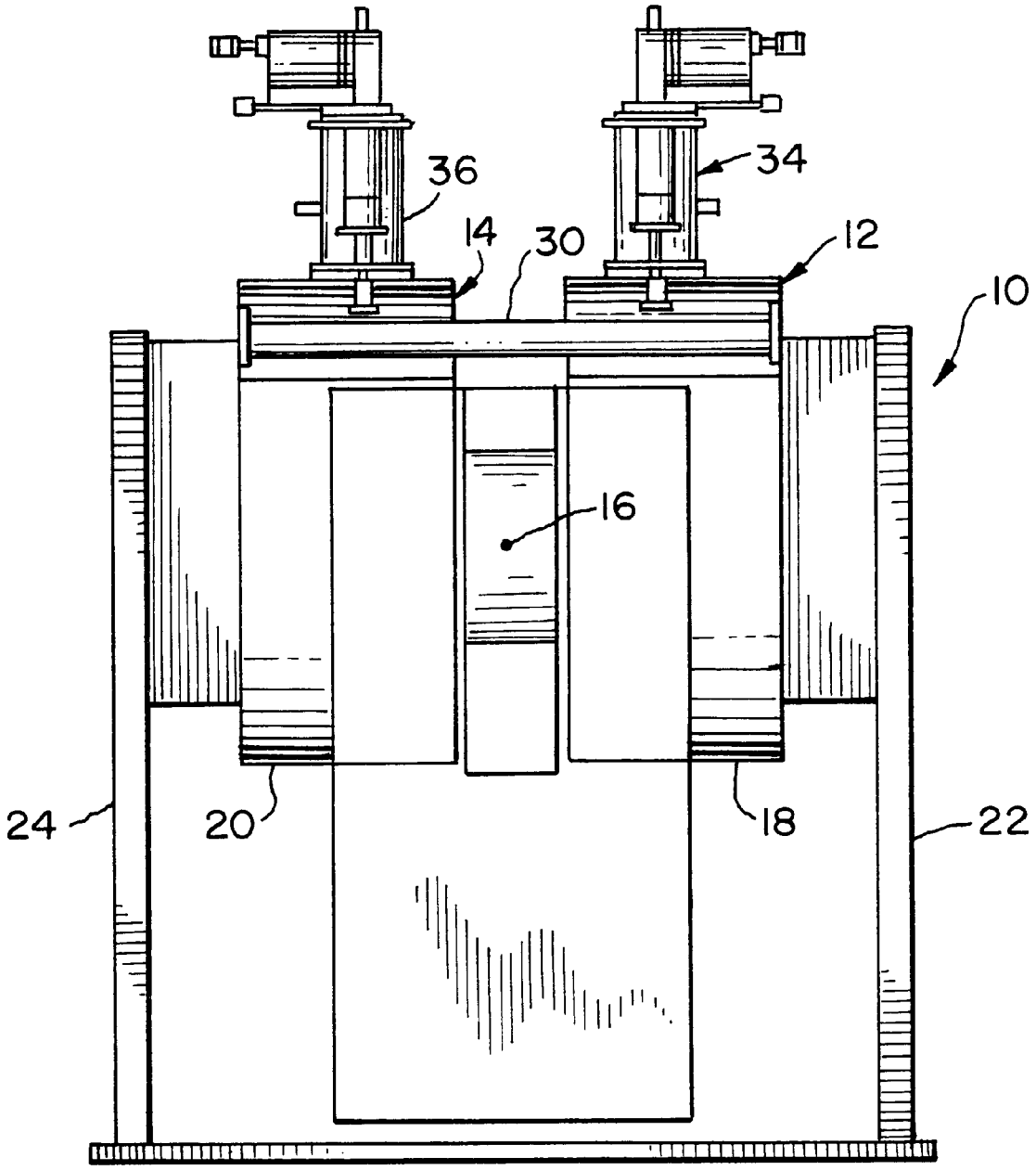
FIG. 3 is a front view of the magnet assembly of FIG. 1.

Referring to FIGS. 1, 2, and 3 the superconducting magnet system or assembly according to the present invention is shown generally as 10. The system includes a first magnet coil assembly 12 and a second magnet coil assembly 14 spaced apart from one another to define a central magnetic field point that is accessible along an X, Y, or Z axis generated from the central point which is shown as 16 in FIGS. 1, 2 and 3.

Each of the magnetic coil assemblies 12, 14 is enclosed in an outer vacuum tight housing 18, 20. Each magnet coil assembly 12, 14 is supported by vertical stands or supports 22, 24, 26 and 28 respectively which can be of any height, depending upon the use to which the superconducting magnet assembly is placed, and cross members 30, 32.

Each magnet coil assembly 12, 14 has associated with it a closed cycle two stage refrigerator 34, 36 generally referred to as a Gifford-McMahon (cycle) refrigerator. Each of the cryogenic refrigerators 34, 36 is a refrigerator adapted to produce a first stage temperature of about 50° K and a second stage temperature of about 4° K. One particular refrigerator useful in the present invention is manufactured and sold by Leybold Cryogenics North America of Hudson, N.H., under the designation 4.2 GM.

Figure 4:
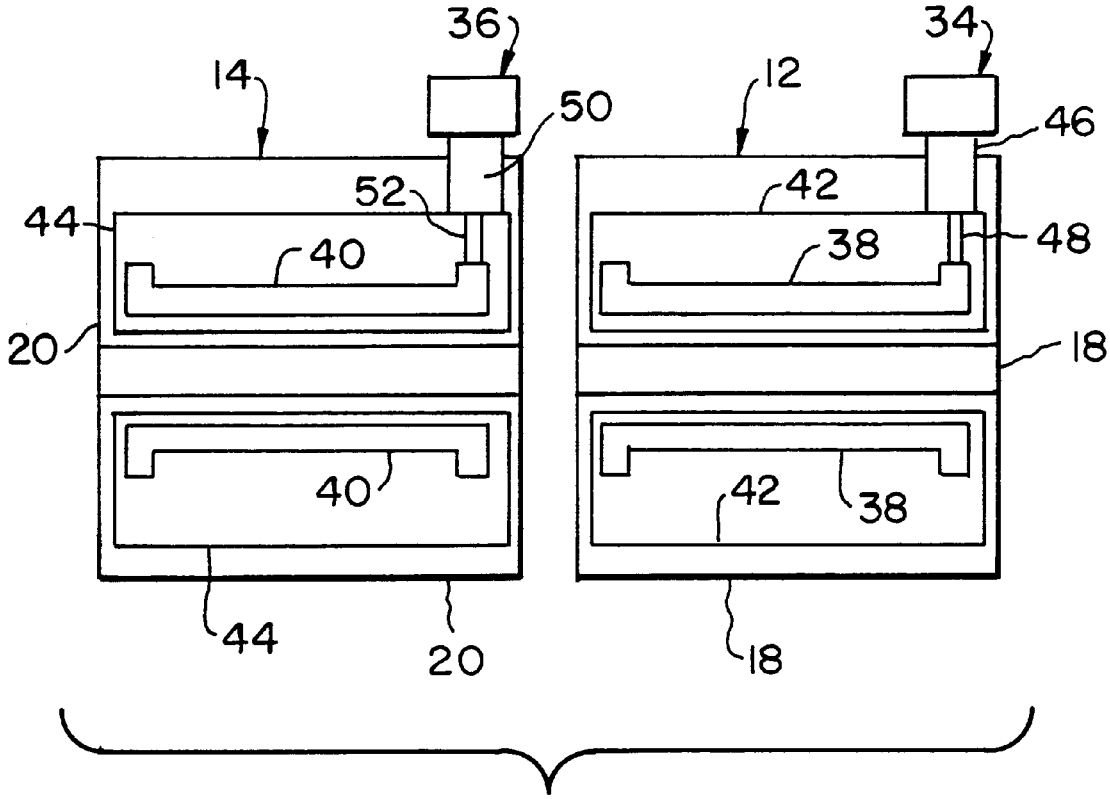
FIG. 4 is a schematic representation of the magnet assembly of the invention illustrating cooling of the magnet.

Referring to FIG. 4, each of the magnet coil assemblies 12, 14 has an outer vacuum housing 18, 20. Housing 18 contains the magnet coil 38, while housing 20 contains the magnet coil 40. Disposed between the magnet coil 38 and the housing 18 is a radiation shield 42, and between the magnet coil 40 and the housing 20 is a radiation shield 44. A first two stage closed cycle cryogenic refrigerator 34 is disposed on the housing 18 of magnet assembly 12. The first stage 46 of refrigerator 34 is to thermally connected directly to radiation shield 42 and the second stage 48 of refrigerator 34 is thermally connected directly to the magnet coil 38. In a like manner, the first stage 50 of refrigerator 36 is thermally connected directly to the radiation shield 44 and a second stage 52 of refrigerator 36 is thermally connected directly to the magnet coil 40. With a two stage cryogenic refrigerator of the type identified above the first stage refrigeration is adapted to cool the heat shields 42, 44 to a temperature of about 50° K and the second stage refrigeration is adapted to cool the magnet coils 38, 40 to a temperature of about 4° K. Thus, the magnet coils can be cooled to a temperature at which superconductivity takes place.

Figure 5:
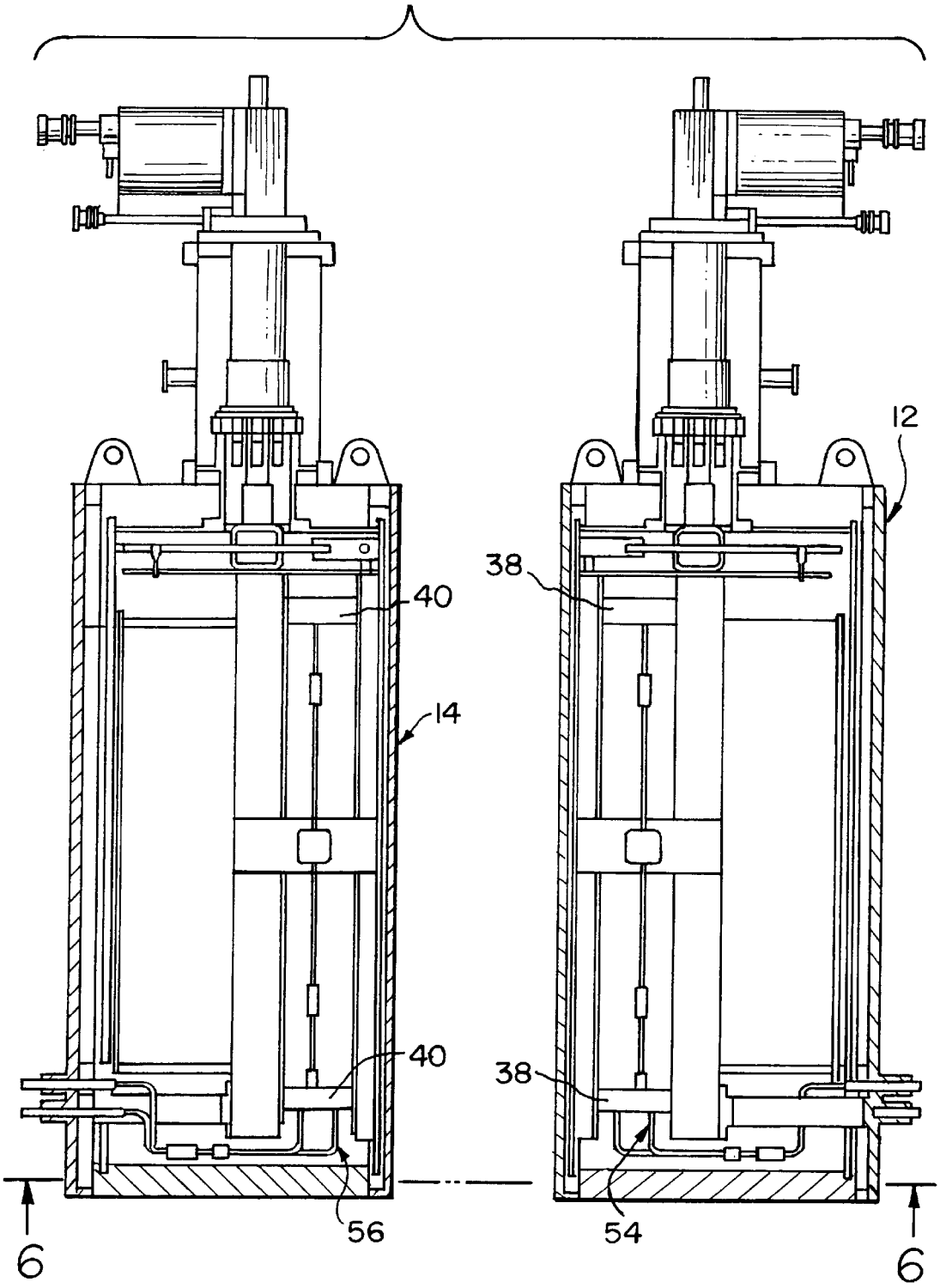
FIG. 5 is an enlarged front view partially in section of the individual magnet coil assemblies of a magnet according to the present invention.
Figure 6:
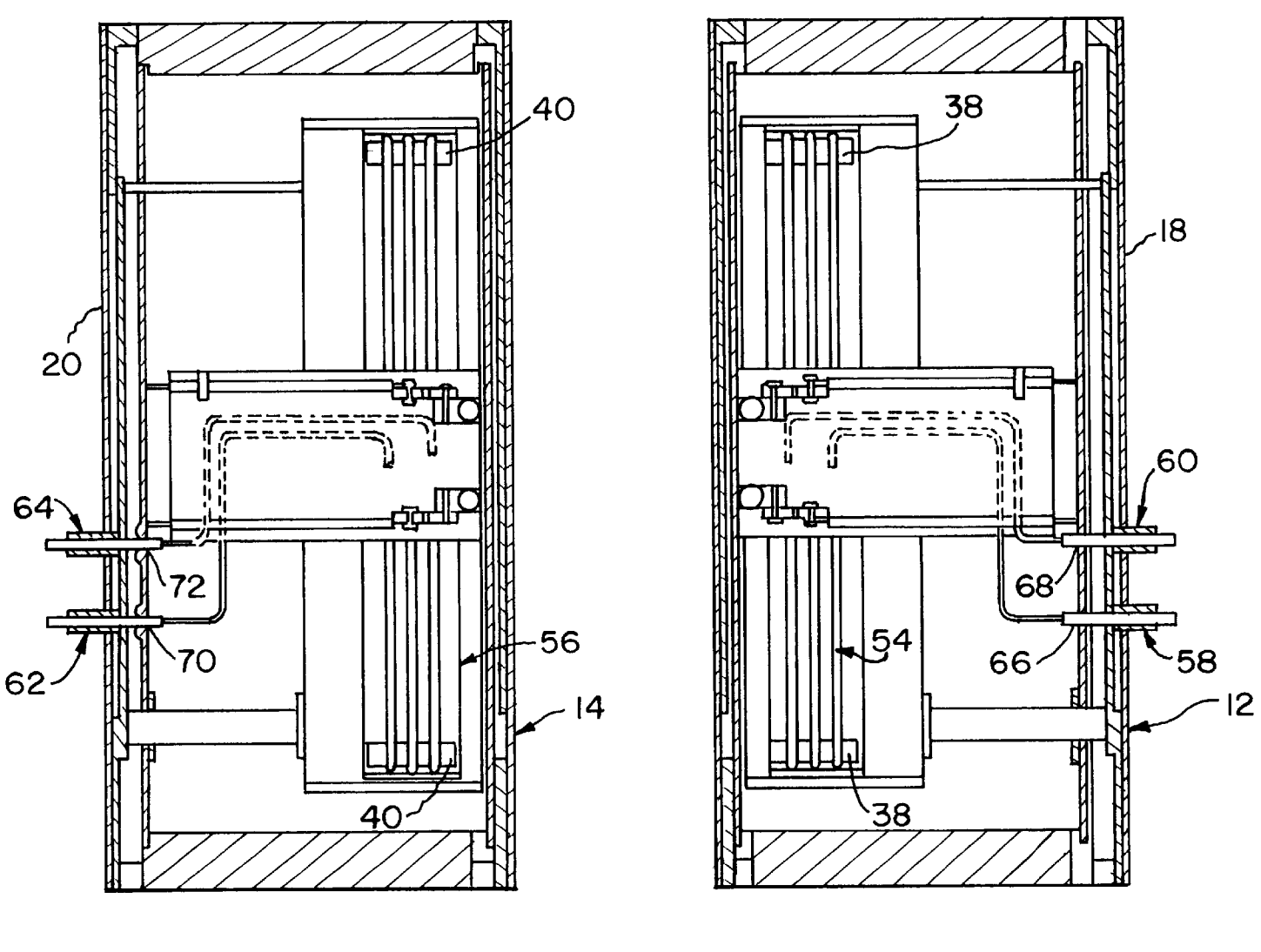
FIG. 6 is a view taken along lines 6—6 of FIG. 5.

As shown in FIGS. 5 and 6, magnet assemblies 12 and 14 can contain several turns of a conductive tubing wrapped around the magnet coils 38 and 40 respectively. A liquid cryogen, (e.g., liquid nitrogen or liquid helium), can be circulated through the tubular coils 54, 56 to effect a rapid cool-down of the magnet coils 38, 40 and the magnet 10. The position of the conductive coils 54, 56 is shown in more detail in the view of FIG. 6.

The tubing can be of any conductive metal, copper being preferred. The copper tubing can be connected to low thermal conductivity stainless steel fittings 58, 60, 62. 64 which penetrate the vacuum housings or vacuum jackets 18, 20 to permit introduction of liquid cryogen into the coiled tubing 54, 56 to rapidly cool the magnet coils 38, 40. To further reduce conductive heat loads on the inner mass of the magnet 10 the stainless steel tubing used in conjunction with the copper tubing has an intermediate thermal anchor point (shown at 66, 68, 70, and 72 respectively in FIG. 5), attached to the intermediate radiation shields 42, 44 in the magnet coil assembly housings 18, 20.

Each magnet coil 38, 40 is fabricated by winding composite wires having a nominal outer diameter of 1 mm containing niobium titanium superconducting filaments onto an aluminum mandrel. The completed coil with the multiple turns is then vacuum impregnated to produce a structure with good mechanical and electrical properties. By pumping electrical currents through the multiple turns very high magnetic fields can be generated. Because the electrical currents flow through a superconducting medium with no electrical resistance, there is no electrical Joules heating generated by the superconducting circuit.

According to the invention, mechanical two-stage closed cycle refrigerators are used to cool a superconducting coil and thereby eliminate the necessity to use liquid cryogen in normal operation.

As set forth above, each superconducting coil is housed in a vacuum jacket or a vacuum dewar and independently conduction cooled by a two stage Gifford-McMahon cryogenic cooler of the type identified above.

One of the unique features of the magnet assembly according to the present invention, results from the provision of two separate individually cooled magnet coils that are liquid cryogen-free and are incorporated into a single system where there is complete open access between the central room temperature gap and the middle of both halves.

The housings, vacuum dewars or vacuum jackets for the superconducting coils are supported by horizontal fiber glass reinforced plastic supports and vertical stainless steel supports. These structures are used to support the coils gravitationally and against the large electromagnetic forces. The housing in each instance is evacuated and maintained at a pressure below $10^{-5}$ torr.

One of the major external heat loads from outside the vacuum dewars is conductive heating through the magnetic current leads. Traditional systems use normal resistive leads fabricated from materials such as copper or brass. However, these resistive leads generate high heat loads through conduction and Joules heating when high-currents are run through them to energize the superconducting coils. The heating generated from these resistive metal leads is too excessive for the two stage cryogenic refrigerator to handle.

The use of high-temperature superconductor leads reduces the heat source to a level where two stage cryogenic refrigerators can operate effectively. Because the high temperature superconducting materials are ceramic, the conductive heat loads are much lower when compared to the normal metallic resistive leads. The high temperature superconductor leads can also maintain the superconducting properties at temperatures above 80° K, which eliminates localized Joules heating at the connection to the cold superconducting coils.

An energized superconducting coil and an external iron yoke are used by the system of the present invention to produce the magnetic field. The iron yoke is fabricated from standard magnetic grade steel and is used to both enhance and shape the field. Due to saturation in the iron, this method is only viable for generated fields of the order of 2 Tesla (20,000 Gauss).

One of the unique features of the superconducting magnet system according to the present invention is the use of two opposing independently operated liquid cryogen-free superconducting magnet units to generate a central high magnetic field within the gap separating the two units. This room temperature gap provides for a complete access from the vertical and horizontal planes for user interfaces.

According to the present invention, each coil half can be energized independently of the other half. With both coils energized with the same current polarity, a high homogenous high-magnetic field is generated between the central gap separating the two units. With the two coils energized with opposing current polarity, a zero field can be generated at the center with a large magnetic field gradient extending outwardly.

Thus, the superconducting magnet system of the present invention utilizes two opposing liquid cryogen-free superconducting magnet units to provide complete vertical and horizontal central room temperature access. The present invention also features use of two separate liquid nitrogen/liquid helium heat exchangers to aid in rapid cool-down of the magnets.

Another feature of the present invention is that while the magnet coils can be cooled to approximately 4° K, they can also be cooled to the higher temperatures, e.g. no the temperature of the intermediate radiation shield, if the magnet coils are fabricated from a high temperature super conducting material.

A magnet system awaiting to the present invention was constructed and had the following performance characteristics:

a) 1.7 Tesla (17,000 Gauss) central magnetic field.

b) ±3% field inhomogeneity over the central working volume.

c) 1.5° field divergence angle over the central working volume.

With the system according to the present invention with a coil mass of 100 Kg (220 lbs.) it required approximately 100 hours to cool using only the two stage closed cycle refrigerators. By circulating liquid helium through the heat exchanger coil, cool-down time was reduced to approximately 10 hours. Another feature of the present invention is the fact that cooling by liquid cryogen circulating through the coils and cooling by the closed cycle refrigerators can take place simultaneously.

Other types of two stage cryogenic refrigerators or cryocoolers, such as two stage pulsed tube refrigerators, can be used in place of the Gifford-McMahon refrigerators.

Having thus described my invention what is desired to be secured by Letters Patent of the United States is set forth in the appended claims, which should be read without limitation.

What is claimed:

1. A superconducting magnet assembly comprising in combination:

two separate toroidally shaped superconducting magnet coils positioned in spaced apart relationship to define access to a magnetic field along an X, Y, and Z axis originating from the center of the magnetic field, each of said magnet coils contained within and spaced apart from an outer vacuum jacket;

at least one radiation shield disposed within each of said vacuum jackets between each of said magnet coils and its vacuum jacket; and two separate two stage closed cycle refrigerators, each of said two stage closed cycle refrigerators having a second stage, with said second stage of each of said two stage closed cycle refrigerators directly connected to a different one of said magnet coils to cool said magnet coils to a temperature at which superconductivity takes place, and a first stage of each of said two stage closed cycle refrigerators directly connected to a radiation shield for said magnet coil cooled by said second stage of said two stage closed cycle refrigerator to cool said radiation shield to a temperature above said temperature at which superconductivity takes place.

2. A superconducting magnet assembly according to claim 1 including auxiliary means to cool said magnet coils by circulating a liquid cryogen around said coils.

3. An assembly according to claim 2 wherein said means includes individual cooling coils fabricated from a tubular conductive metal wrapped around each of said magnet coils, each of said cooling coils having an inlet and outlet penetrating each of said respective vacuum jackets.

4. An assembly according to claim 3 including means to circulate a liquid cryogen through each of said cooling coils.

5. An assembly according to claim 4 wherein said liquid cryogen is selected from the group consisting of nitrogen and helium.

6. A superconducting magnet assembly according to claim 1 including means to separately energize each of said magnet coils.

7. A superconducting magnet assembly according to claim 1 including means to generate opposing magnetic fields in said magnet coils.

8. A superconducting magnet assembly according to claim 1 wherein each of said magnet coils consists of multiple turns of niobium titanium superconducting filaments wound onto an aluminum mandrel and vacuum impregnated to produce a coil structure.

9. A superconducting magnet assembly according to claim 8 wherein each magnetic coil includes an external iron yoke.

10. A method for cooling a superconducting magnet having two separate toroidally shaped superconducting magnet coils positioned in spaced apart relationship to define access to a magnetic field along an X, Y, and Z axis originating from the center of the magnetic field, each of said magnet coils contained within and spaced apart from an outer vacuum jacket; at least one radiation shield disposed within each of said vacuum jackets between each of said magnet coils and its vacuum jacket; a separate two stage closed cycle refrigerator to cool each of said magnet coils to a temperature at which said magnet coils exhibit superconductivity and each of said radiation shields to a temperature above said temperature to which said magnet coils are cooled. and individual cooling coils fabricated from a tubular conductive metal wrapped around each of said magnet coils, each of said cooling coils having an inlet and outlet penetrating each of said respective vacuum jackets; comprising the steps of energizing said refrigerators to cool said magnet coils and said radiation shields and circulating a liquid cryogen through each of said cooling coils.

11. A method to claim 10 including the steps of selecting said liquid cryogen from the group consisting of liquid nitrogen, and liquid helium.

12. A method according to claim 10 including the steps of separately energizing each of said magnet coils.

13. A method according to claim 10 including the steps of generating opposing magnetic fields in said magnet coils.

14. A method according to claim 10 including the step of delaying energizing of said refrigerators for a period of time while circulating liquid cryogen through said cooling coils.

15. A method according to claim 10 including the steps of first introducing liquid nitrogen into said cooling coils for a set period of time to pre-cool said magnet coils, followed by introducing liquid helium into said cooling coils to cool said magnet coils to a desired operating temperature.

* * * * *